US009574351B2

(12) United States Patent
Karr et al.

(10) Patent No.: US 9,574,351 B2
(45) Date of Patent: Feb. 21, 2017

(54) STANDING SEAM PANELS

(71) Applicant: Mazzella Holding Company, Inc., Cleveland, OH (US)

(72) Inventors: Ron Karr, Houston, TX (US); Adam Binderup, Westminster, CO (US)

(73) Assignee: Mazzella Holding Company, Inc, Cleveland, OH (US)

( * ) Notice: Subject to any disclaimer, the term of this patent is extended or adjusted under 35 U.S.C. 154(b) by 0 days.

(21) Appl. No.: 14/683,733

(22) Filed: Apr. 10, 2015

(65) Prior Publication Data

US 2016/0298334 A1 Oct. 13, 2016

(51) Int. Cl.

| | |
|---|---|
| ***E04D 3/367*** | (2006.01) |
| ***E04D 3/363*** | (2006.01) |
| ***E04D 3/361*** | (2006.01) |
| ***E04D 13/00*** | (2006.01) |
| ***E04D 15/00*** | (2006.01) |

(52) U.S. Cl.

CPC ..... *E04D 3/364* (2013.01); *E04D 3/361* (2013.01); *E04D 3/363* (2013.01); *E04D 13/00* (2013.01); *E04D 15/00* (2013.01)

(58) Field of Classification Search

CPC ..... E04D 3/364; E04D 3/363; E04D 3/361; E04D 15/00; E04D 13/00

USPC ..... 52/528

See application file for complete search history.

(56) References Cited

U.S. PATENT DOCUMENTS

| | | | | | |
|---|---|---|---|---|---|
| 3,394,524 | A | * | 7/1968 | Howarth | B21D 39/02 52/529 |
| 3,982,373 | A | * | 9/1976 | Wilson | E04D 3/30 52/522 |
| 4,091,588 | A | * | 5/1978 | Heirich | E04D 3/363 52/478 |
| 4,192,117 | A | * | 3/1980 | Heirich | E04D 3/363 52/478 |
| 4,495,743 | A | * | 1/1985 | Ellison | E04D 3/363 52/478 |
| 4,694,628 | A | | 9/1987 | Vondergoltz et al. | |
| 4,700,522 | A | | 10/1987 | Simpson | |
| 4,870,798 | A | * | 10/1989 | Richter | E04D 3/364 52/528 |
| 4,918,797 | A | * | 4/1990 | Watkins | B21D 39/02 29/243.5 |
| 5,038,543 | A | | 8/1991 | Neyer | |
| 5,241,785 | A | * | 9/1993 | Meyer | E04D 3/363 52/478 |
| 5,247,772 | A | | 9/1993 | Greenberg | |
| 5,363,624 | A | * | 11/1994 | Cotter | E04D 3/366 52/466 |
| 5,507,126 | A | * | 4/1996 | Wu | E04D 3/363 52/335 |

(Continued)

*Primary Examiner* — Brent W Herring

(74) *Attorney, Agent, or Firm* — Roger D. Emerson; Emerson Thomson Bennett, LLC

(57) ABSTRACT

A standing seam panel for interlocking engagement with adjacent standing seam panels. The standing seam panel includes a strip of sheet material having a central panel portion, a male sidelap portion, and a female sidelap portion sized and contoured to receive the male sidelap portion of an adjacent standing seam panel. The female sidelap portion includes a first latch flange engaged with the male sidelap portion and the male sidelap portion includes a second latch flange engaged with the female sidelap portion.

3 Claims, 17 Drawing Sheets

(56) References Cited

U.S. PATENT DOCUMENTS

| | | | | | |
|---|---|---|---|---|---|
| 5,535,567 | A * | 7/1996 | Cahoon | E04D 3/363 | 52/520 |
| 5,685,118 | A * | 11/1997 | Simpson | E04C 3/08 | 52/520 |
| 5,692,352 | A | 12/1997 | Simpson | | |
| 5,715,639 | A | 2/1998 | Yamada | | |
| 5,980,156 | A * | 11/1999 | Morello | E21D 11/15 | 405/124 |
| 6,115,899 | A * | 9/2000 | Rider | B21D 39/02 | 29/243.5 |
| 6,301,853 | B1 | 10/2001 | Simpson et al. | | |
| 6,588,170 | B2 | 7/2003 | Simpson et al. | | |
| 6,889,478 | B1 | 5/2005 | Simpson | | |
| 7,574,839 | B1 | 8/2009 | Simpson | | |
| D603,534 | S * | 11/2009 | Menegoli | D25/139 | |
| 7,694,484 | B2 | 4/2010 | Lucas et al. | | |
| 7,874,117 | B1 | 1/2011 | Simpson | | |
| 7,984,596 | B1 | 7/2011 | Simpson et al. | | |
| 8,312,605 | B1 * | 11/2012 | Rider | E04D 3/364 | 29/243.5 |
| 8,732,917 | B2 * | 5/2014 | Zeilenga | F24J 2/5249 | 24/514 |
| 2002/0083672 | A1 * | 7/2002 | Ostenfeldt | E04B 9/0478 | 52/536 |
| 2012/0047827 | A1 * | 3/2012 | Zeilenga | F24J 2/5249 | 52/173.3 |

* cited by examiner

LB
SECOND STATION

R4
FOURTH STATION

K8

STANDING SEAM PANELS

TECHNICAL FIELD

This patent application is directed to metal roofing panels, more specifically, to standing seam panels that can be snapped together and subsequently seamed for added strength. The application is further directed to roll-forming machines capable of forming the disclosed standing seam panels.

BACKGROUND

Traditional standing seam panel roofing systems are available as snapped-together panels or panels that require mechanical seaming. Snap-together panels can be quickly installed; however, this type of panel may provide less uplift resistance than mechanically seamed panel systems. Installation of mechanically seamed panel systems involves additional time and labor to seam adjacent panels to one another. Thus, there are very few options, if any, for standing seam roof panel systems that are both quickly installed and also provide increased uplift resistance.

SUMMARY

Provided herein is a standing seam panel for interlocking engagement with adjacent standing seam panels. In an embodiment, the standing seam panel comprises a strip of sheet material including a central panel portion, a male sidelap portion, and a female sidelap portion sized and contoured to receive the male sidelap portion of an adjacent standing seam panel. The female sidelap portion includes a first standing flange extending transversely from the central panel portion, a first cross-flange extending transversely from the first standing flange, a first return flange extending transversely from the first cross-flange, a first ledge extending transversely from the first return flange, and a latching flange extending from the first ledge. The male sidelap portion includes a second standing flange extending transversely from the central panel portion, a second cross-flange extending transversely from the second standing flange, a second return flange extending transversely from the second cross-flange toward the central panel portion and latchable with the first ledge of an adjacent standing seam panel, and a second ledge disposed on the second standing flange and positioned to latch with the latching flange of an adjacent standing seam panel.

In some embodiments, the first ledge and the latching flange comprise a locking flange. In some embodiments, the first return flange is substantially parallel to the first standing flange. In some embodiments, the first return flange is substantially perpendicular to the first cross-flange. In some embodiments, the first ledge extends toward the first standing flange. In some embodiments, the first ledge is substantially perpendicular to the first standing flange. In some embodiments, at least a portion of the second return flange is substantially parallel to the second standing flange. In some embodiments, the second return flange includes a locking portion extending away from the second standing flange.

Also provided herein is a standing seam panel assembly that includes a first standing seam panel including a male sidelap portion and a second standing seam panel including a female sidelap portion sized to receive the male sidelap portion for interlocking engagement therein. The female sidelap portion includes a first latch flange engaged with the male sidelap portion and the male sidelap portion includes a second latch flange engaged with the female sidelap portion.

In some embodiments, the female sidelap portion includes a first standing flange, a first cross-flange extending transversely from the first standing flange, a first return flange extending transversely from the first cross-flange, a first ledge extending transversely from the first return flange, and wherein the first latch flange extends from the first ledge. In some embodiments, the male sidelap portion includes a second standing flange, a second cross-flange extending transversely from the second standing flange and a second ledge disposed on the second standing flange. In some embodiments, the second latch flange extends transversely from the second cross-flange. In some embodiments, the first latch flange is engaged with the second ledge. In some embodiments, the first standing seam panel includes a second female sidelap portion and the second standing seam panel includes a second male sidelap portion.

Further provided herein is a standing seam panel system that includes a first standing seam panel including a male sidelap portion and a second standing seam panel including a female sidelap portion sized to receive the male sidelap portion for interlocking engagement therein. The male sidelap portion includes a return flange engaged with the female sidelap portion and the female sidelap portion includes a latch flange engageable with the male sidelap portion. The system also includes a seaming mechanism attachable to the snapped together male and female sidelap portions and including a plurality of rollers operative to urge the latch flange toward the male sidelap portion thereby engaging the latch flange with the male sidelap portion.

In some embodiments, the male sidelap portion includes a standing flange, a cross-flange extending transversely from the standing flange and a ledge disposed on the standing flange, wherein the return flange extends transversely from the cross-flange. In some embodiments, the latch flange is engaged with the ledge. In some embodiments, the seaming mechanism is operative to bend the return flange toward the standing flange.

Also provided is a roll-forming machine adapted to form a strip of material into a standing seam roof panel. In an embodiment, the roll-forming machine includes a frame including a forming region through which the strip may be advanced in a downstream direction from an upstream entrance to a downstream exit, and a drive mechanism mounted to the frame and operative to engage the strip and advance the strip in the downstream direction.

A plurality of male sidelap forming elements are supported by the frame and positioned to engage a first longitudinal margin of the strip and operative to progressively form the first longitudinal margin into a male sidelap portion that includes a first standing flange, a first cross-flange extending from the first standing flange, and a first return flange extending from the first cross-flange as the strip is advanced through the forming region by the drive mechanism. The machine also includes a first plurality of cooperative ledge forming elements operative to form a first ledge on the first standing flange protruding toward the first return flange.

A plurality of female sidelap forming elements are supported by the frame and positioned to engage a second longitudinal margin of the strip opposite the first longitudinal margin and operative to progressively form the second longitudinal margin into a female sidelap portion that includes a second standing flange, a second cross-flange extending from the second standing flange, and a second return flange extending from the second cross-flange as the strip is advanced through the forming region by the drive mechanism. The machine also includes a second plurality of cooperative ledge forming elements operative to form a second ledge on the second return flange protruding toward the second standing flange.

In some embodiments, the first plurality of cooperative ledge forming elements comprises four rollers defining first and second stations. In some embodiments, the first station includes a first roller having a first bead and a second roller having a first groove mateable with the first bead. In some embodiments, the first bead has a contour in the form of a right triangle. In some embodiments, the first and second rollers are mounted for rotation about first and second substantially parallel axes. In some embodiments, the second station includes a third roller having a second bead, and a fourth roller having a second groove mateable with the second bead. In some embodiments, the third roller includes a third groove adjacent the second bead and the fourth roller includes a third bead adjacent the second groove and mateable with the third groove. In some embodiments, the third and fourth rollers are mounted for rotation about third and fourth axes, wherein the third and fourth axes are oriented at an angle with respect to each other. In some embodiments, the third and fourth axes are oriented at an acute angle with respect to each other. In some embodiments, the second plurality of cooperative ledge forming elements includes third and fourth stations. The third station includes a fifth roller including a fourth bead and a sixth roller including a fourth groove mateable with the fourth bead. The fourth station includes a seventh roller including a fifth bead and an eighth roller including a fifth groove mateable with the fifth bead. In some embodiments, the fifth and sixth rollers are mounted for rotation about fifth and sixth axes, wherein the fifth and sixth axes are substantially parallel with respect to each other. In some embodiments, the seventh and eighth rollers are mounted for rotation about seventh and eighth axes, wherein the seventh and eighth axes are oriented at an angle with respect to each other. In some embodiments, the seventh and eighth axes are oriented at an acute angle with respect to each other. In some embodiments, the seventh roller includes a sixth groove adjacent the fifth bead, and the eighth roller includes a sixth bead adjacent the fifth groove and mateable with the sixth groove.

Also provided herein is a forming element set for use on a roll-forming machine that is adapted to form a longitudinal margin of a strip of material into a male sidelap profile. The forming element set includes a plurality of male sidelap forming elements that, when mounted on a roll-forming machine, are positioned to engage the longitudinal margin and operative to progressively form the longitudinal margin into a male sidelap portion that includes a standing flange, a cross-flange extending from the standing flange, and a return flange extending from the cross-flange as the strip is advanced through the roll-forming machine, and a plurality of cooperative ledge forming elements operative to form a ledge on the standing flange protruding toward the return flange.

In some embodiments, the plurality of cooperative ledge forming elements includes first and second stations. The first station includes a first roller including a first bead and a second roller including a first groove mateable with the first bead. The second station includes a third roller including a second bead and a fourth roller including a second groove mateable with the second bead. In some embodiments, the roll-forming set also includes a plurality of female sidelap forming elements that, when mounted on the roll-forming machine, are positioned to engage a second longitudinal margin of the strip opposite the first longitudinal margin and operative to progressively form the second longitudinal margin into a female sidelap portion that includes a second standing flange, a second cross-flange extending from the second standing flange, and a second return flange extending from the second cross-flange as the strip is advanced through the roll-forming machine and a second plurality of cooperative ledge forming elements operative to form a second ledge on the second return flange protruding toward the second standing flange. In some embodiments, the second plurality of cooperative ledge forming elements includes third and fourth stations. The third station includes a fifth roller including a fourth bead and a sixth roller including a fourth groove mateable with the fourth bead. The fourth station includes a seventh roller including a fifth bead and an eighth roller including a fifth groove mateable with the fifth bead. In some embodiments, the first, second, fifth, and sixth rollers are mounted for rotation about first, second, fifth, and sixth axes, wherein the first, second, fifth, and sixth axes are substantially parallel with respect to each other.

These and other aspects of the disclosed technology will be apparent after consideration of the Detailed Description and figures herein. It is to be understood, however, that the scope of the invention shall be determined by the claims as issued and not by whether given subject matter addresses any or all issues noted in the background or includes any features or aspects recited in this summary.

BRIEF DESCRIPTION OF THE DRAWINGS

The standing seam panels and roll-forming machines introduced here may be better understood by referring to the following Detailed Description in conjunction with the accompanying drawings, in which like reference numerals indicate identical or functionally similar elements.

Figure 1:
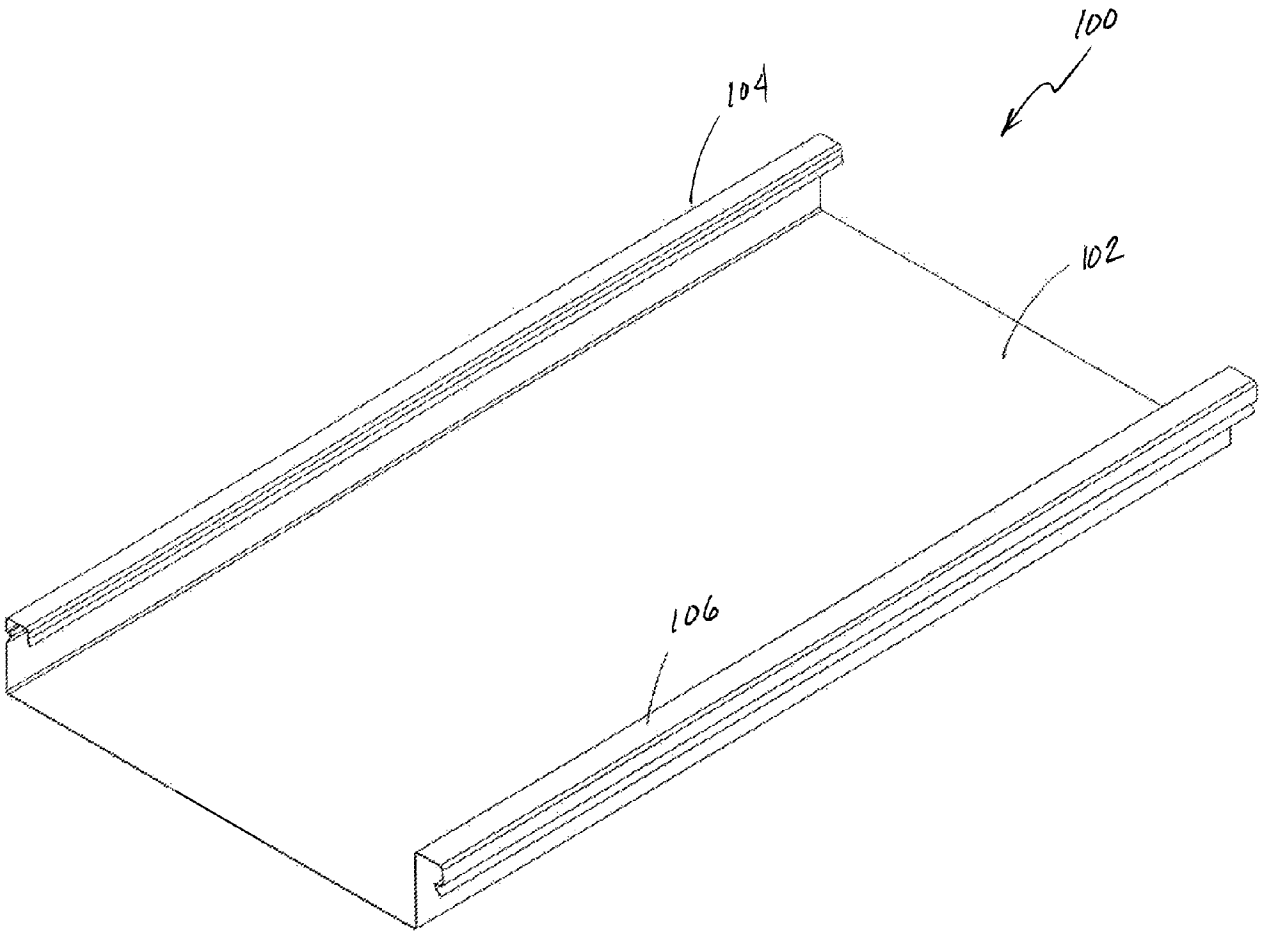
FIG. 1 is a perspective view of a standing seam panel according to a representative embodiment.

The headings provided herein are for convenience only and do not necessarily affect the scope or meaning of the claimed embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of the embodiments as defined by the appended claims.

DETAILED DESCRIPTION

Overview

Standing seam panels, assemblies, and systems as well as roll-forming machines for forming standing seam panels are disclosed. The standing seam panel is configured for interlocking engagement with an adjacent standing seam panel of the same or similar construction. The standing seam panel comprises a strip of sheet material that includes a central panel portion, a male sidelap portion, and a female sidelap portion. In an embodiment, the disclosed standing seam panel system includes a first standing seam panel including a male sidelap portion and a second standing seam panel including a female sidelap portion sized to receive the male sidelap portion for interlocking engagement therein. The male sidelap portion includes a return flange that latches with the female sidelap portion in a snapped-together configuration. The female sidelap portion includes a latch flange engageable with the male sidelap portion. The system also includes a seaming mechanism attachable to the snapped together male and female sidelap portions. The seaming mechanism includes a plurality of rollers operative to urge the latch flange toward the male sidelap portion thereby engaging the latch flange with the male sidelap portion. Accordingly, the disclosed standing seam panels can be quickly snapped together for initial installation on a roof structure to provide immediate protection. Although the snapped-together panels provide suitable uplift resistance, additional assembly strength is provided when the panel assembly is seamed together.

General Description

Various examples of the panels, assemblies, systems, and machines introduced above will now be described in further detail. The following description provides specific details for a thorough understanding and enabling description of these examples. One skilled in the relevant art will understand, however, that the technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

FIG. 1 illustrates a standing seam panel 100 that is configured for interlocking engagement with an adjacent standing seam panel of the same or similar construction. Standing seam panel 100 comprises a strip of sheet material that includes a central panel portion 102, a male sidelap portion 104, and a female sidelap portion 106.

Figure 2:
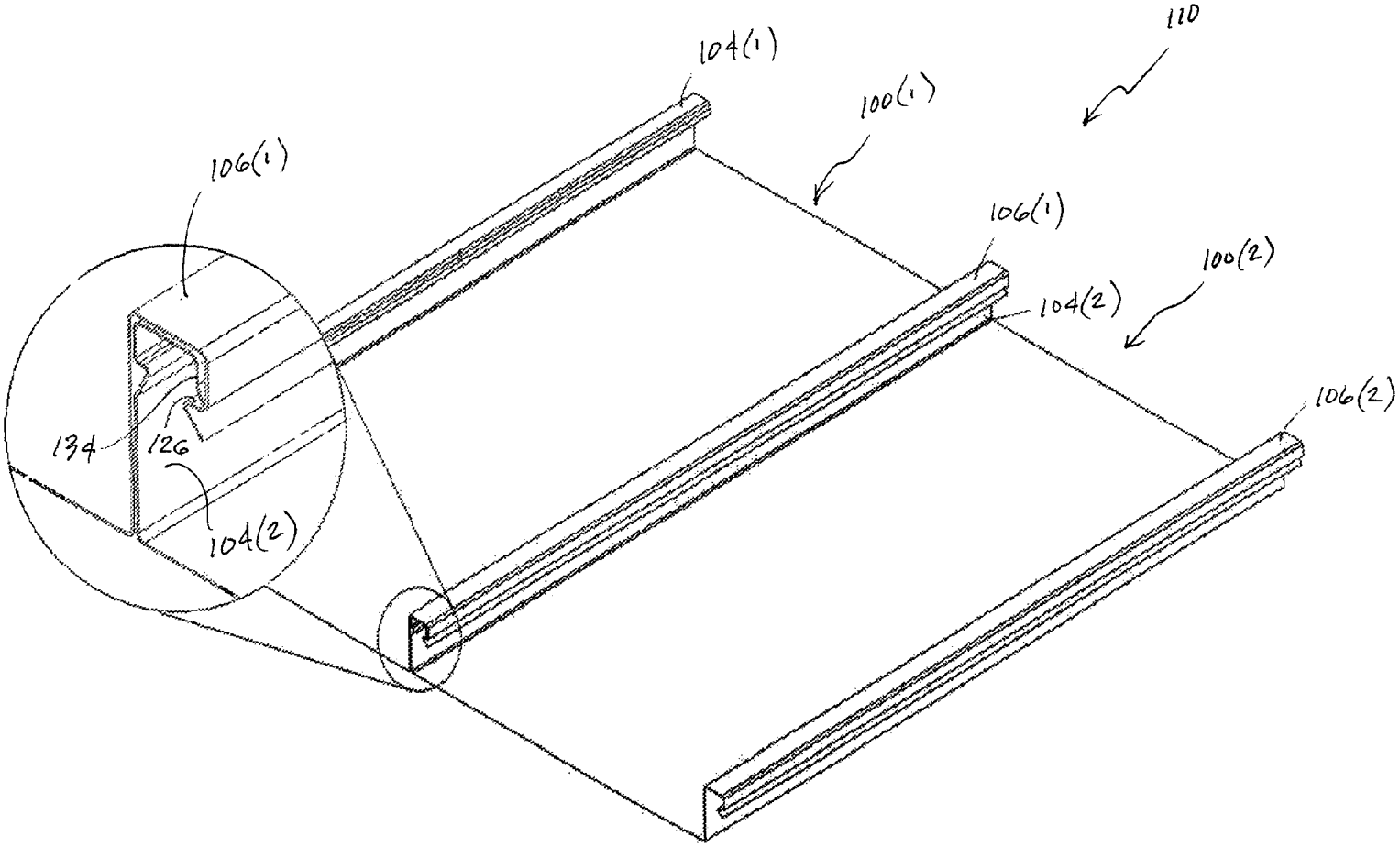
FIG. 2 is a perspective view of a standing seam panel assembly that has been snapped together.
Figure 3:
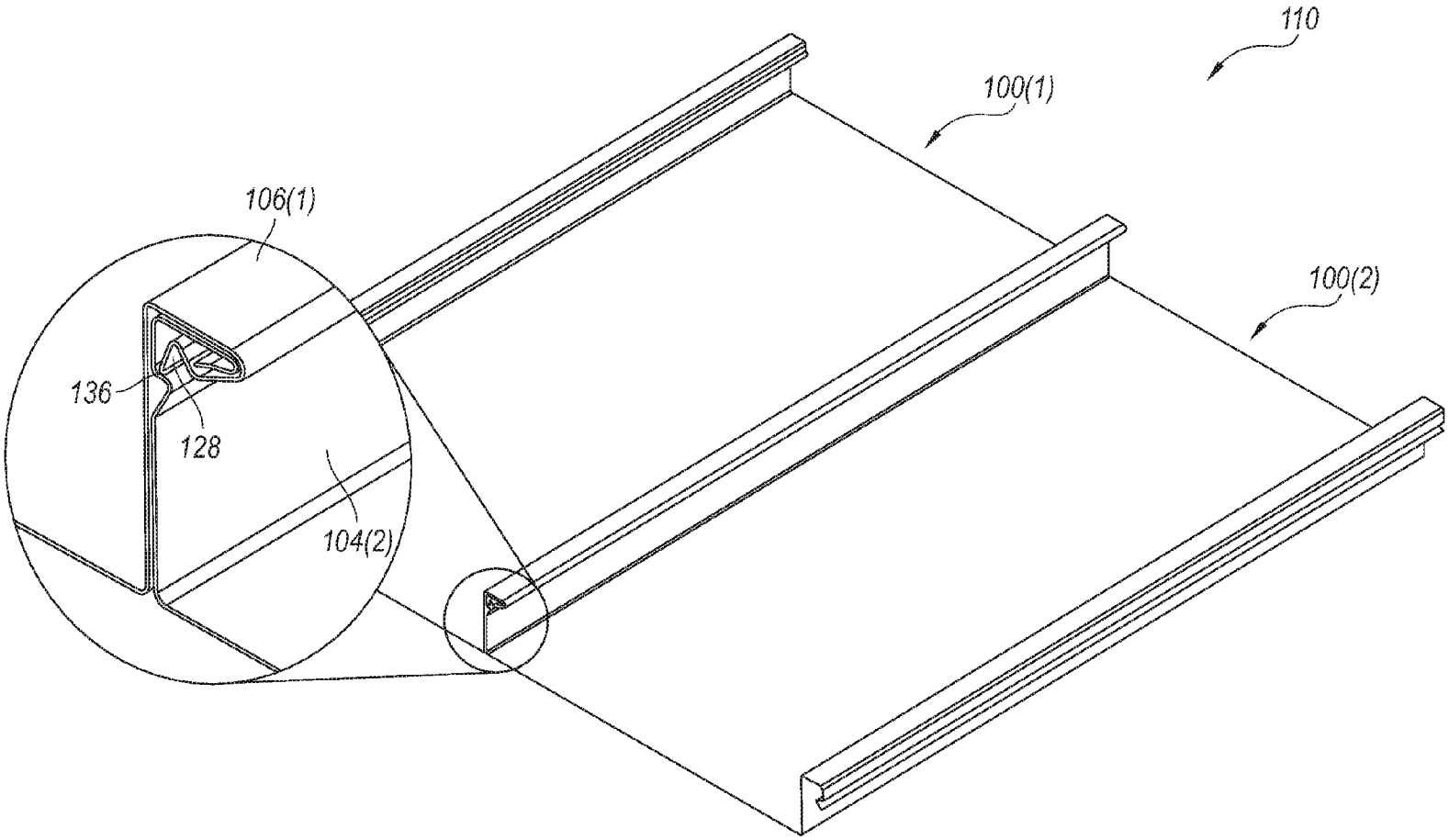
FIG. 3 is the standing seam panel assembly shown in FIG. 2 that has been seamed together.

With further reference to FIG. 2, adjacent standing seam panels 100(1) and 100(2) can be assembled together to form standing seam panel assembly 110. Female sidelap portion 106(1) is sized and contoured to receive the male sidelap portion 104(2) for interlocking engagement therein. When snapped together, return flange 134 of male sidelap portion 104(2) latches against ledge 126 of the female sidelap portion 106(1). FIG. 2 illustrates that standing seam panels 100(1) and 100(2) can be manually snapped together by pushing the female sidelap portion 106(1) onto the male sidelap portion 104(2). Turning to FIG. 3, the male sidelap portion 104(2) and the female sidelap portion 106(1) can also be seamed together for a more permanent installation. When seamed, the latching flange 128 of the female sidelap portion 106(1) latches with ledge 136 that is formed in male sidelap portion 104(2).

Figure 4A:
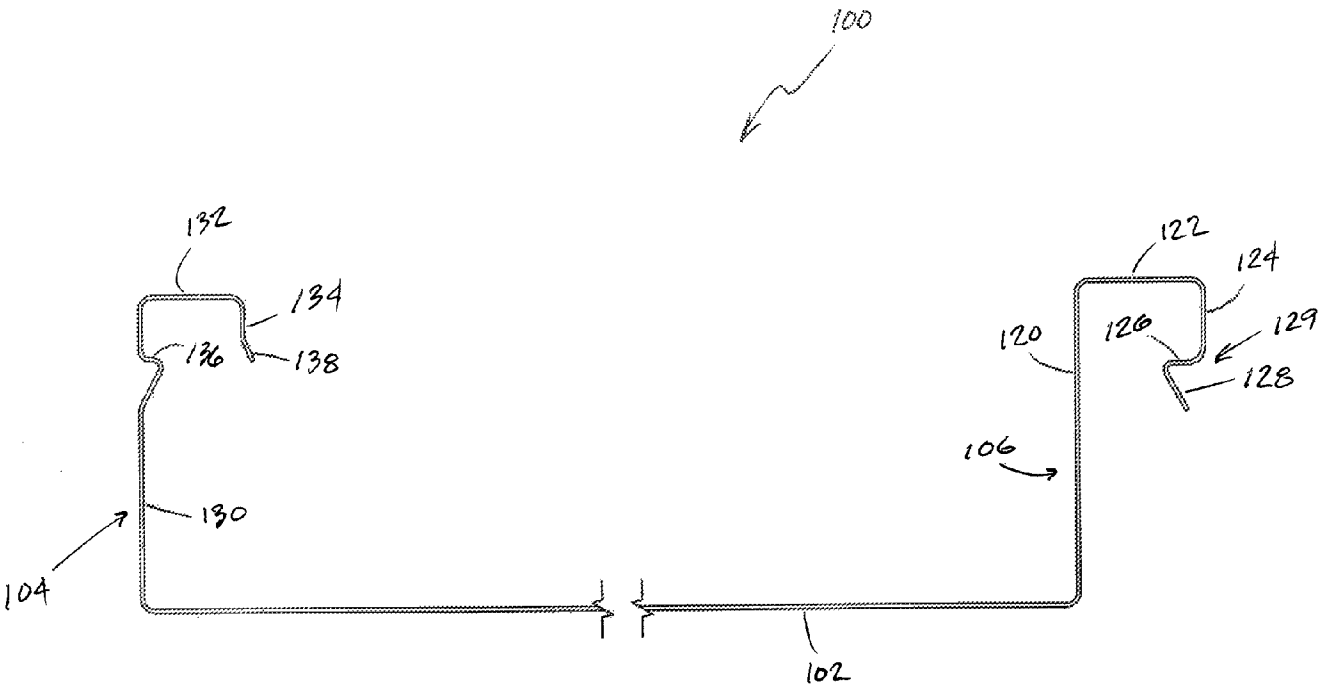
FIG. 4A is an end view of the standing seam panels shown in FIGS. 1-3.

As shown in FIG. 4A, female sidelap portion 106 includes a first standing flange 120 extending transversely from the central panel portion 102. A first cross-flange 122 extends transversely from the first standing flange 120. A first return flange 124 extends transversely from the first cross-flange 122. A first ledge 126 extends transversely from the first return flange 124. A latching flange 128 extends from the first ledge 126. The first ledge 126 and the latching flange 128 comprise a locking flange 129.

Also shown in FIG. 4A, male sidelap portion 104 includes a second standing flange 130 extending transversely from the central panel portion 102. A second cross-flange 132 extends transversely from the second standing flange 130. A second return flange 134 extends transversely from the second cross-flange 132 toward the central panel portion 102. A second ledge 136 is disposed on the second standing flange 130 and is positioned to latch with the latching flange 128 of an adjacent standing seam panel. In some embodiments, the return flange 134 can include a locking portion 138 that extends away from the second standing flange 130.

As can be appreciated in FIG. 4A, the flanges of female sidelap portion 106 preferably extend transversely to each other at approximately 90 degrees. In other words, the flanges are substantially perpendicular to each other. For example, first standing flange 120 extends perpendicularly from central panel portion 102. Similarly, first cross-flange 122 extends perpendicularly from the first standing flange 120. First return flange 124 extends perpendicularly to first cross-flange 122, and first ledge 126 extends perpendicularly from the first return flange 124. First ledge 126 extends perpendicularly from first return flange 124 and towards first standing flange 120. Latching flange 128, however, extends at an acute angle with respect to first ledge 126. In some embodiments, latching flange 128 extends at approximately 50 degrees with respect to first ledge 126. Although the various flanges are described herein as being either perpendicular or at a particular angle with respect to an associated flange, other suitable angles may be used.

Figure 4B:
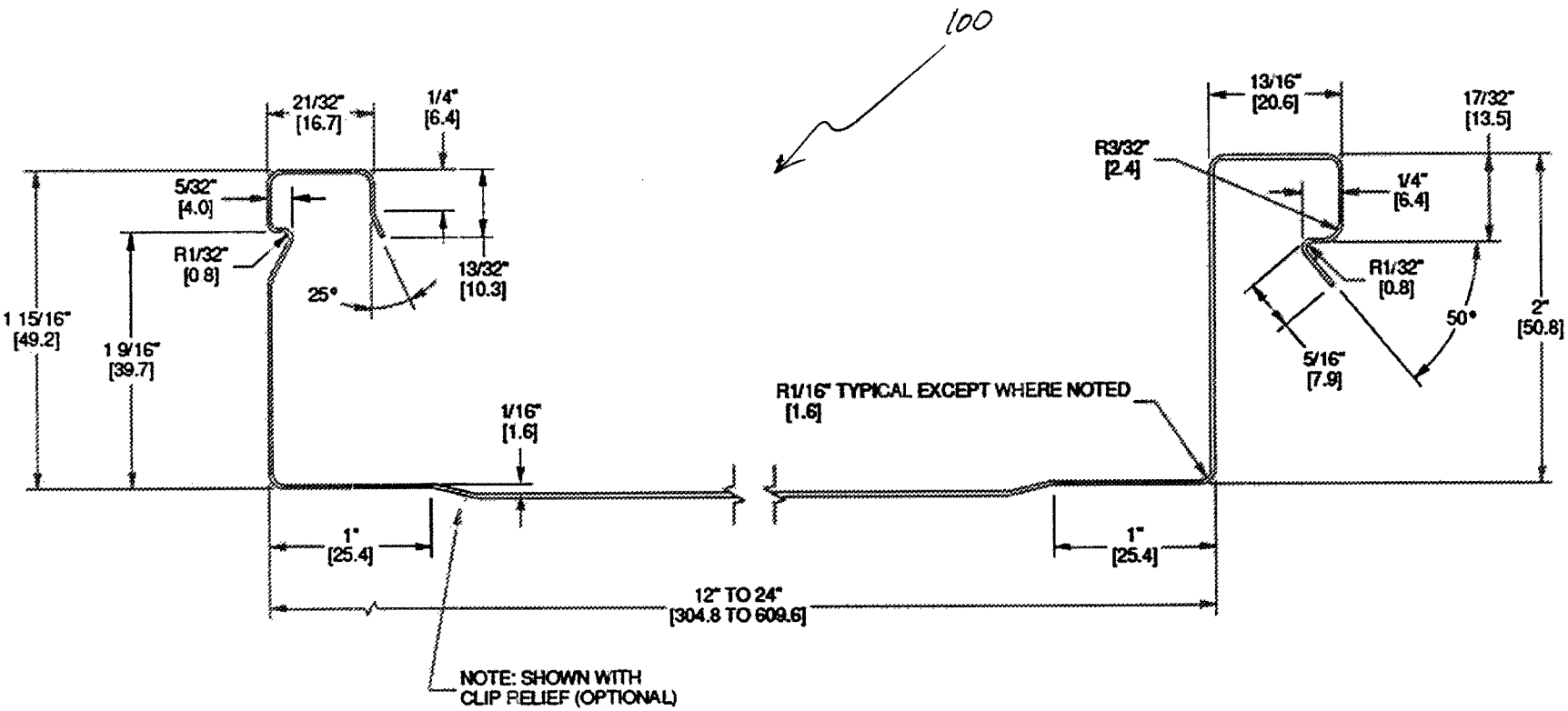
FIG. 4B is an end view of a standing seam panel including dimensions according to a representative embodiment.

As with the female sidelap portion 106, male sidelap portion 104 includes flanges that preferably extend substantially perpendicular to each other. For example, second standing flange 130 extends perpendicularly from central portion 102. Second cross-flange 132 extends perpendicularly from the second standing flange 130, and return flange 134 extends perpendicularly from second cross-flange 132. Locking portion 138, however, preferably extends from second return flange 134 at an angle. For example, locking portion 138 can extend away from the second return flange 134 at approximately 25 degrees. Second ledge 136 includes at least a portion that extends perpendicularly from second standing flange 130. However, as can be appreciated in the figure, at least a portion of ledge 136 is at an angle to standing flange 130. FIG. 4B includes example dimensions of a standing seam panel 100 according to a representative embodiment. In some embodiments, panel 100 comprises steel strip material having a thickness ranging between, for example, 26 GA and 22 GA. In some embodiments, panel 100 comprises aluminum material having a thickness ranging between, for example, 0.024 inches and 0.040 inches.

Figure 5A:
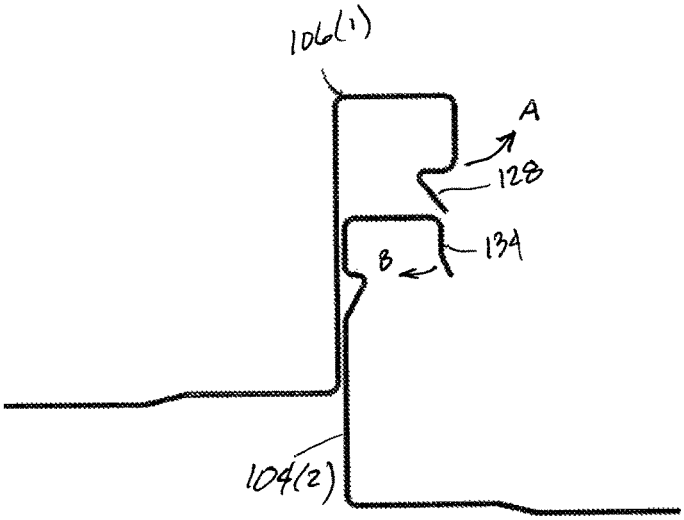
FIG. 5A is an end view illustrating the assembly of two adjacent standing seam panels.
Figure 5B:
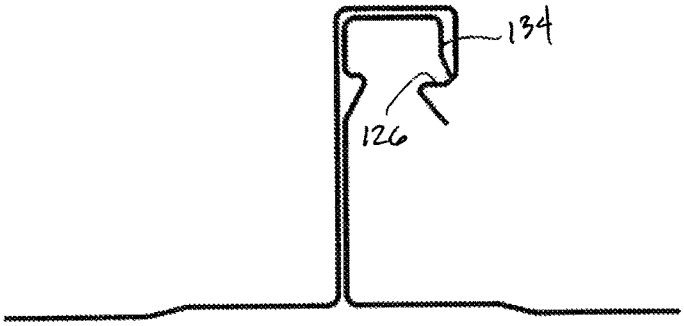
FIG. 5B is an end view illustrating the two adjacent standing seam panels snapped together.
Figure 5C:
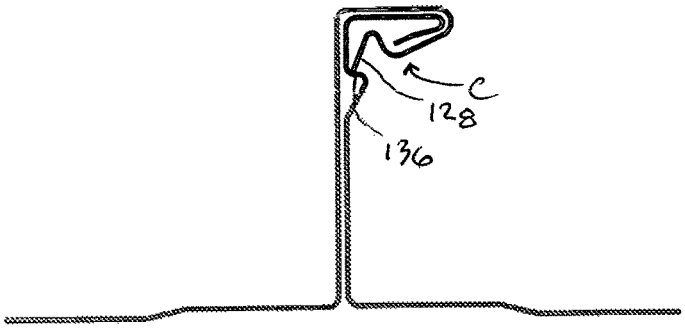
FIG. 5C is an end view illustrating the two adjacent standing seam panels after they have been seamed together.

FIGS. 5A-5C illustrate snapping and seaming two adjacent standing seam panels together. As shown in FIG. 5A, two adjacent panels can be manually snapped together by urging female sidelap portion 106(1) onto male sidelap portion 104(2). As the sidelap portions are pushed together, the first latching flange 128 is displaced in the direction of arrow A when the latching flange 128 abuts second return flange 134. As the panels are further pushed together, the second return flange 134 is moved or deflected, as shown by arrow B. FIG. 5B illustrates the two panels in the snapped-together state whereby the second return flange 134 is latched against first ledge 126. Accordingly, the two panels are now interlocked such that they cannot be pulled apart. FIG. 5C illustrates the two adjacent panels seamed together. The panels are seamed together by urging latching flange 128 in the direction of arrow C such that latching flange 128 latches against second ledge 136. The panels can be seamed together using a suitable seaming mechanism such as that described below with respect to FIGS. 14-16. Accordingly, the disclosed standing seam panels can be quickly snapped together (e.g., FIG. 5B) for initial installation on a roof structure to provide immediate protection. While the snapped-together panels provide suitable uplift resistance, additional assembly strength is provided when the panel assembly is seamed together as shown in FIG. 5C.

Figure 6:
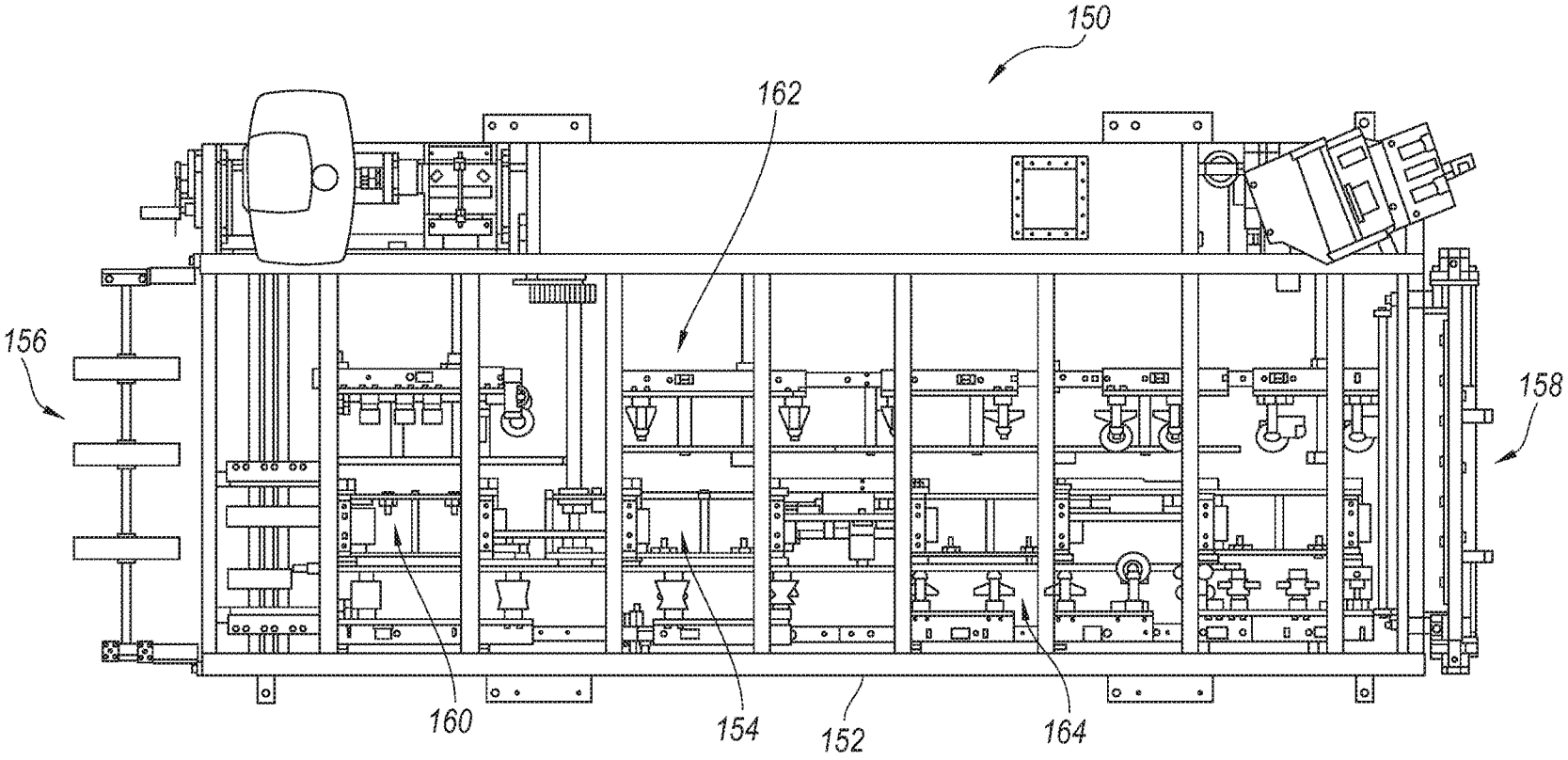
FIG. 6 is a top plan view of a roll-forming machine adapted to form the standing seam panels shown in FIGS. 1-5C.

FIG. 6 illustrates a roll-forming machine 150 adapted to form a strip of material into a standing seam roof panel as shown and described above with respect to FIGS. 1-5C. Roll-forming machine 150 includes a frame 152 having a forming region 154 through which the strip may be advanced in a downstream direction from an upstream entrance 156 to a downstream exit 158. A drive mechanism 160 is mounted to the frame 152 and is operative to engage the strip and advance the strip in the downstream direction. A plurality of male sidelap forming elements 162 are supported by the frame 152 and are positioned to engage a first longitudinal margin of the strip of material and operative to progressively form the longitudinal margin into a male sidelap portion. A plurality of female sidelap forming elements 164 are also supported by the frame 152 and positioned to engage a second longitudinal margin of the strip opposite the first longitudinal margin and to progressively form the second longitudinal margin into a female sidelap portion. Suitable roll-forming machines are available from New Tech Machinery, Corp. of Denver, Colo. and are described in U.S. Pat. Nos. 5,425,259; 6,981,397; 8,011,218; 8,356,502; 8,468,864; and 8,590,354, the disclosures of which are hereby incorporated by reference in their entireties. To the extent the incorporated documents conflict with the present disclosure, the present disclosure controls.

Figure 7:
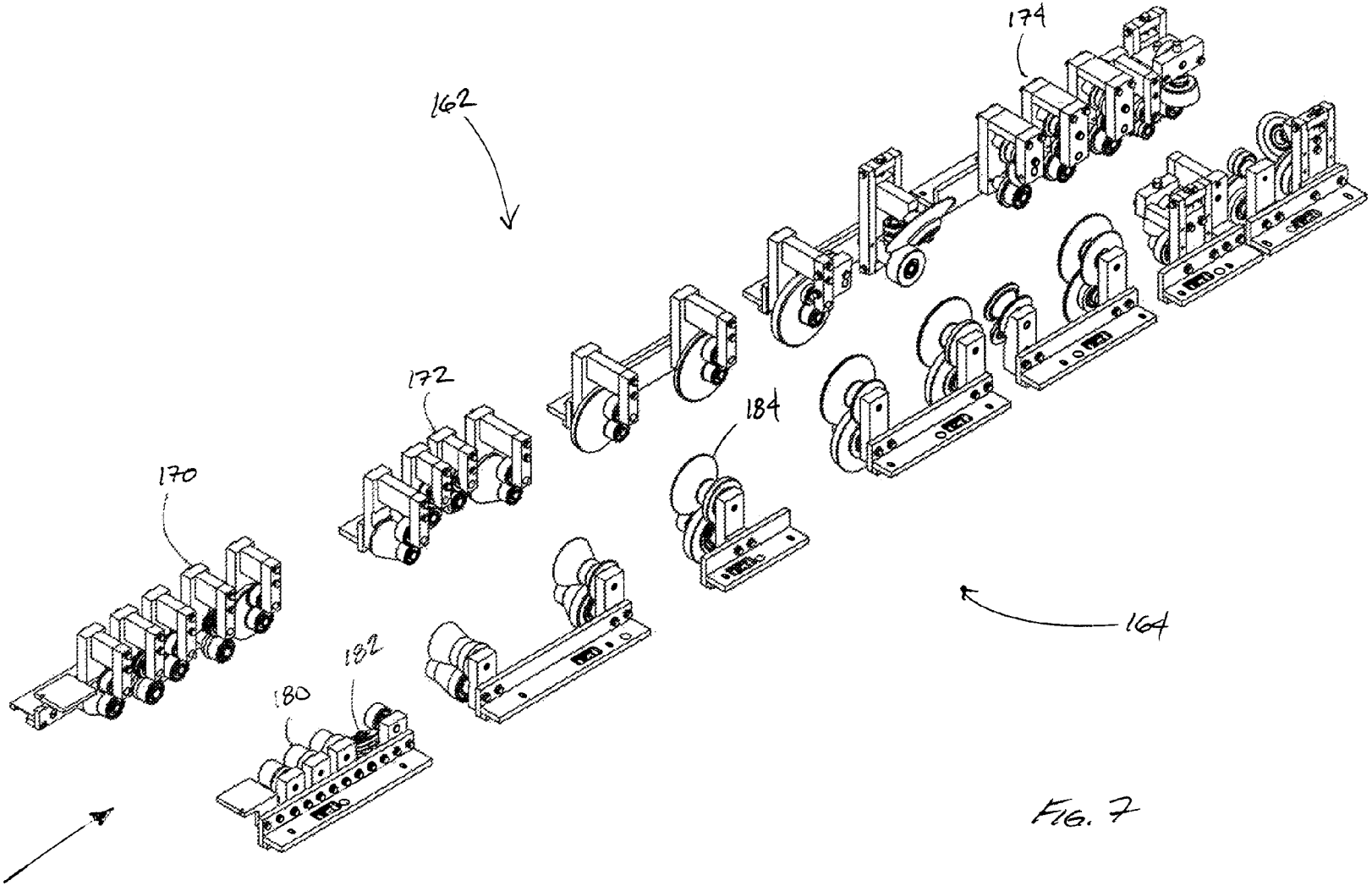
FIG. 7 is a perspective view illustrating male and female sidelap forming elements according to a representative embodiment.

As shown in FIG. 7, the plurality of male sidelap forming elements 162 are positioned opposite the plurality of female sidelap forming elements 164 such that the male and female sidelap portions are formed at approximately the same time as the strip of material is fed through the roll-forming machine 150 (see FIG. 6). The plurality of male sidelap forming elements 162 are organized into a plurality of forming stations, such as forming stations 170, 172, and 174. Similarly, the female sidelap forming elements 164 are organized into stations such as stations 180, 182, and 184. First and second stations 170 and 172 comprise a first plurality of cooperative ledge forming elements (e.g., rollers) that are operative to form the second ledge 136 on the second return flange 130 (see FIG. 4A). Third and fourth stations 180 and 182 comprise a second plurality of cooperative ledge forming elements that are operative to form latching flange 128 on female sidelap portion 106 (see FIG. 4A). Forming stations 174 and 184 provide additional examples of forming stations to illustrate the progressive formation of the sidelap portions.

Figure 8:
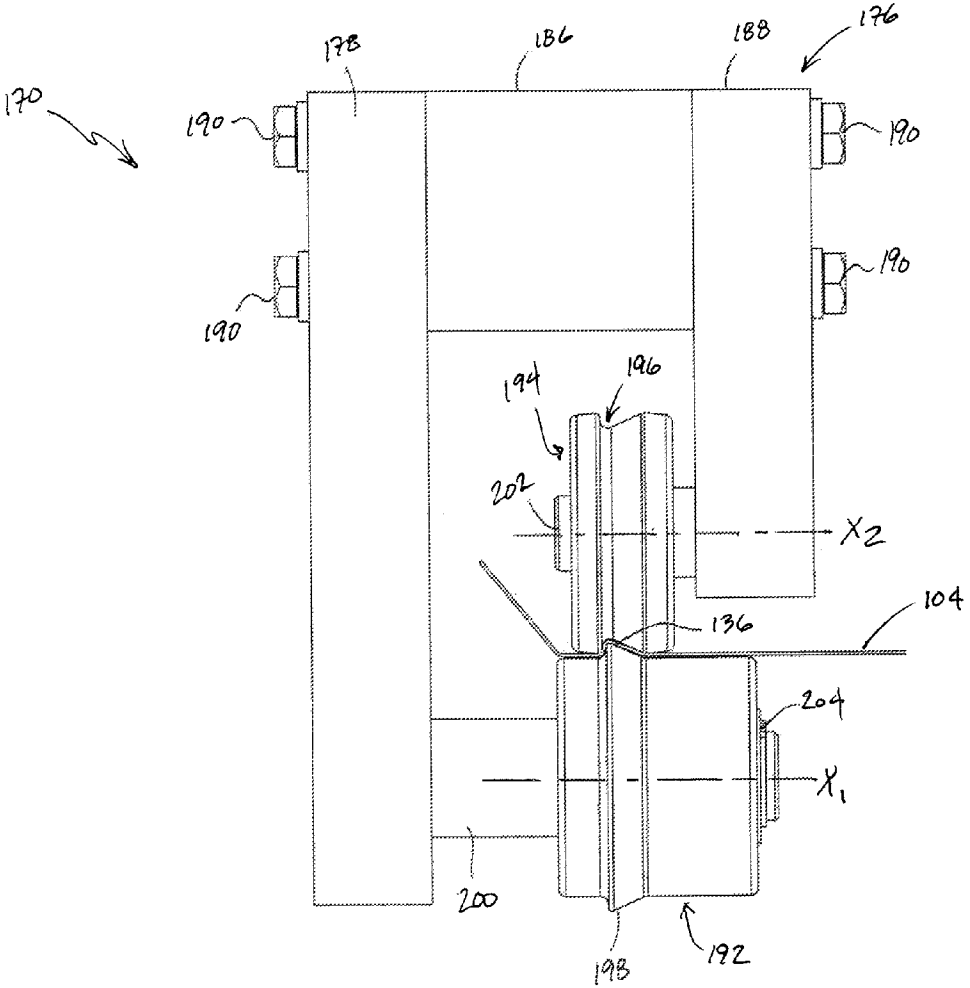
FIG. 8 is a front view of a first forming station for forming the male sidelap portion.
Figure 9:
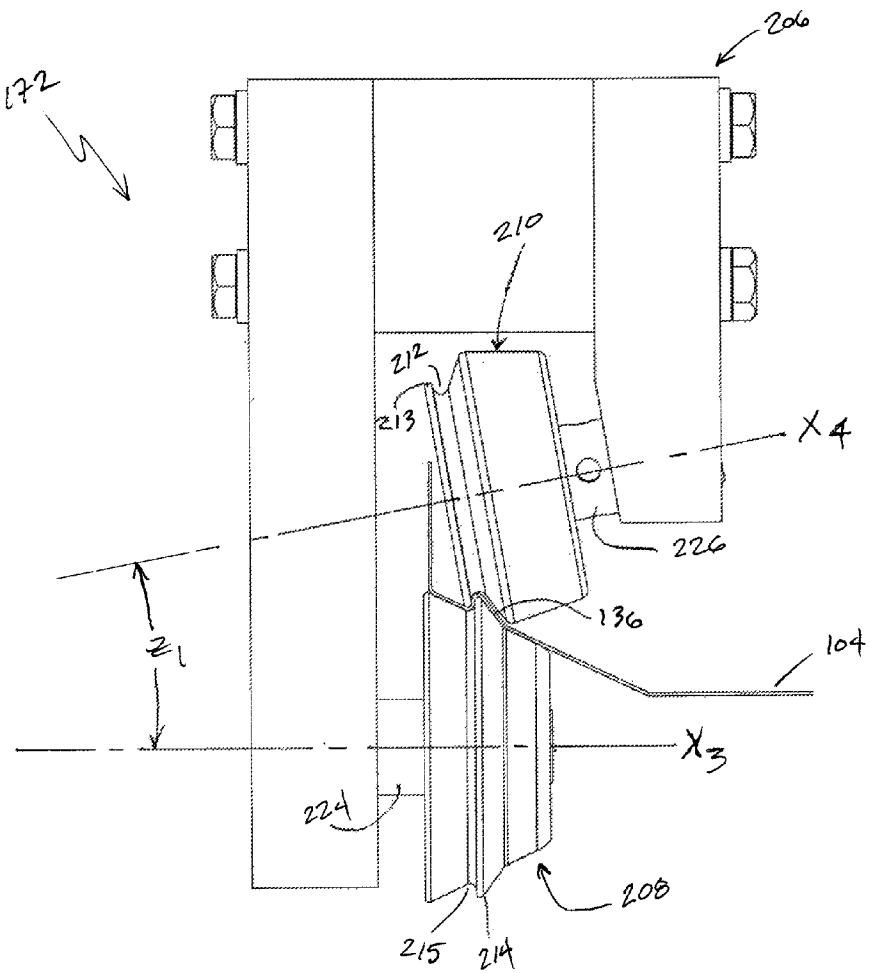
FIG. 9 is a front view of a second forming station for forming the male sidelap portion.

As shown in FIG. 8, forming station 170 includes a mounting bracket 176 that supports a first roller 192 and a second roller 194. Bracket 176 is comprised of blocks 178, 186, and 188 that are fastened together with suitable fasteners 190. First and second rollers 192 and 194 are mounted for rotation on shafts 200 and 202, respectively. Accordingly, first roller 192 is mounted for rotation about axis $X_1$, and roller 194 is mounted for rotation about axis $X_2$. Axes $X_1$ and $X_2$ are substantially parallel to each other. In general, the rollers are retained on their respective shafts by a snap ring 204 or other suitable fastener. First roller 192 includes a first bead 198, and second roller 194 includes a first groove 196 mateable with the first bead 198. In some embodiments, first bead 198 has a contour in the form of a right triangle. As can be seen in FIG. 8, ledge 136 is partially formed in station 170. With further reference to FIG. 9, second station 172 further forms ledge 136. As with first station 170, second station 172 includes a mounting bracket 206 having a similar construction as that described above with respect to first station 170. Second station 172 includes a third roller 208 and a fourth roller 210 mounted on shafts 224 and 226, respectively. Thus, roller 208 is mounted for rotation about axis $X_3$, and roller 210 is mounted for rotation about axis $X_4$. Axes $X_3$ and $X_4$ are oriented at an acute angle $Z_1$ with respect to each other. Third roller 208 includes a second bead 214 and fourth roller 210 includes a second groove 212 mateable with the second bead 214. Third roller 208 also includes a third groove 215 adjacent the second bead 214, and the fourth roller 210 also includes a third bead 213 adjacent the second groove 212 and mateable with the third groove 215.

In addition to referring to the rollers consecutively (i.e., first, second, third, etc.), the rollers may also be referred to by their association with a respective station. For example, first station 170 includes a first station first roller 192 and a first station second roller 194. Similarly, second station 172 includes a second station first roller 208 and a second station second roller 210.

Figure 10:
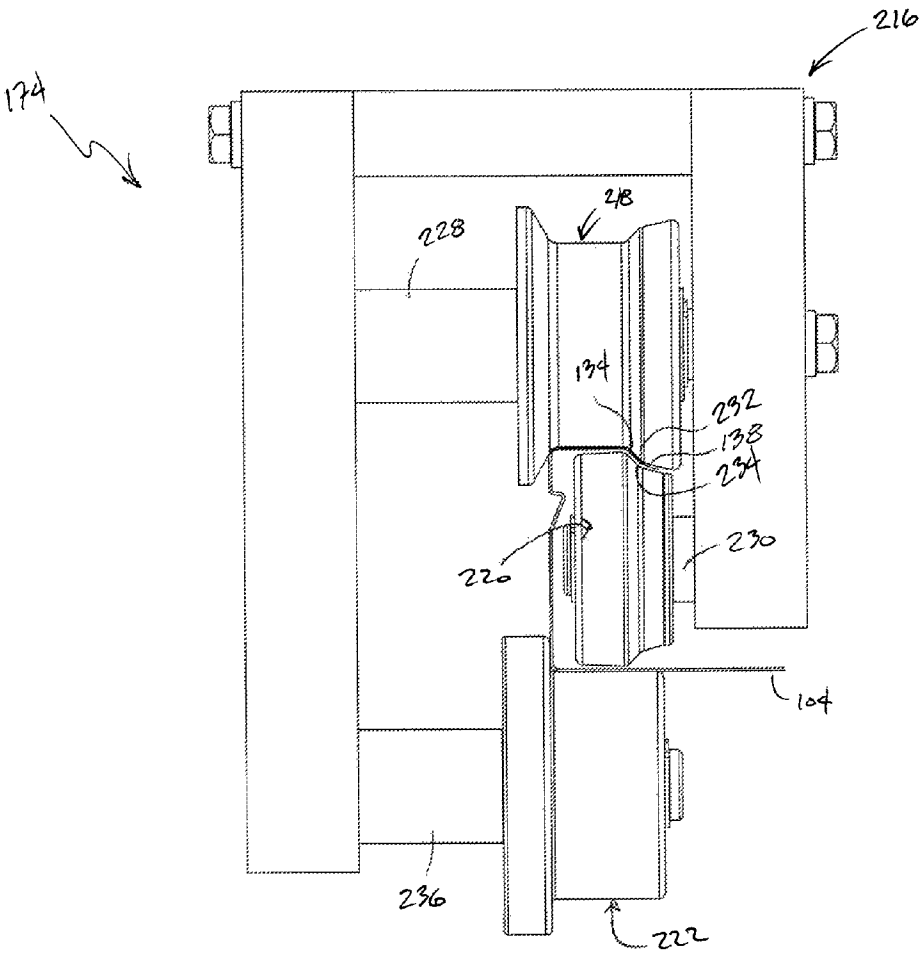
FIG. 10 is a front view of a representative male sidelap forming station.

FIG. 10 illustrates forming station 174 that is representative of the forming element stations. In station 174, mounting bracket 216 supports shafts 228, 230, and 236, which mount rollers 218, 220, and 222, respectively. Roller 222 supports and locates the male sidelap portion 104, while rollers 218 and 220 are operative to form the locking portion 138 on return flange 134. Rollers 218 and 220 include profiled surfaces 232 and 234 that correspond to the shape of the locking portion 138.

Figure 11:
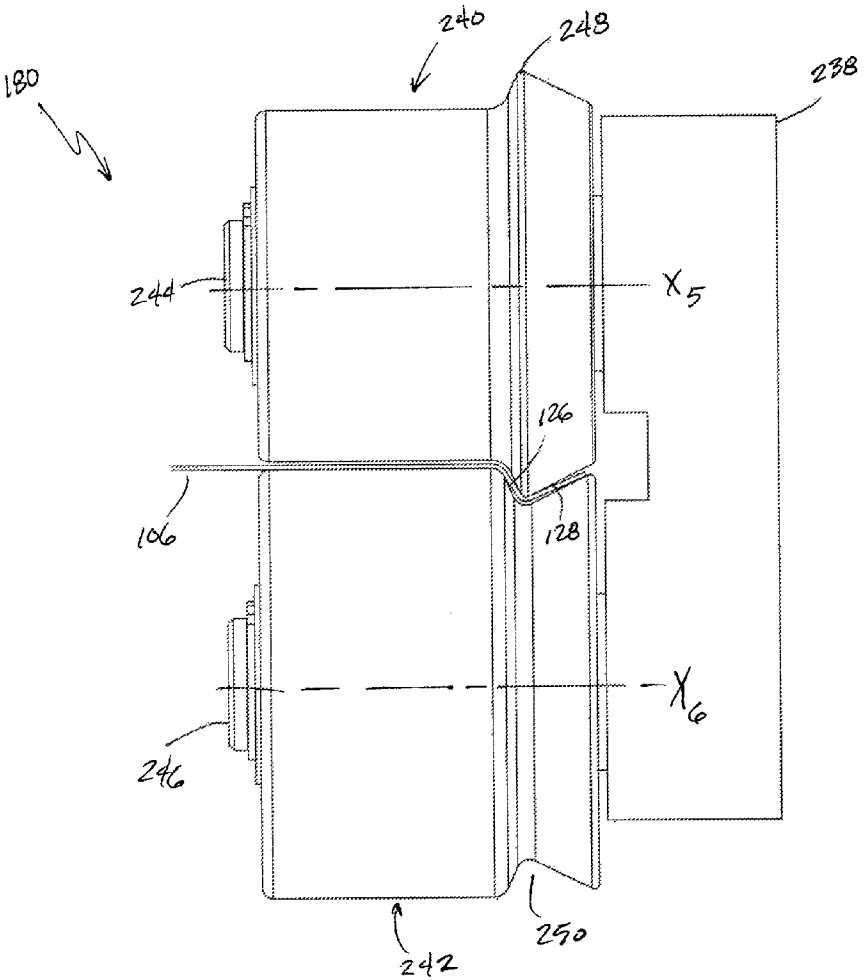
FIG. 11 is a front view of a third forming station for forming the female sidelap portion.

FIG. 11 illustrates third station 180 that is operative to partially form the first ledge 126 and the latching flange 128 on the female sidelap portion 106. Third station 180 includes a mounting bracket 238 with shafts 244 and 246. Third station 180 includes fifth and sixth rollers 240 and 242, respectively, which are rotatably mounted on shafts 244 and 246, respectively. Accordingly, fifth and sixth rollers 240 and 242 are rotatably mounted for rotation about axes $X_5$ and $X_6$, respectively. Fifth roller 240 includes a fourth bead 248, and sixth roller 242 includes a fourth groove 250 that is mateable with the fourth bead 248.

Figure 12:
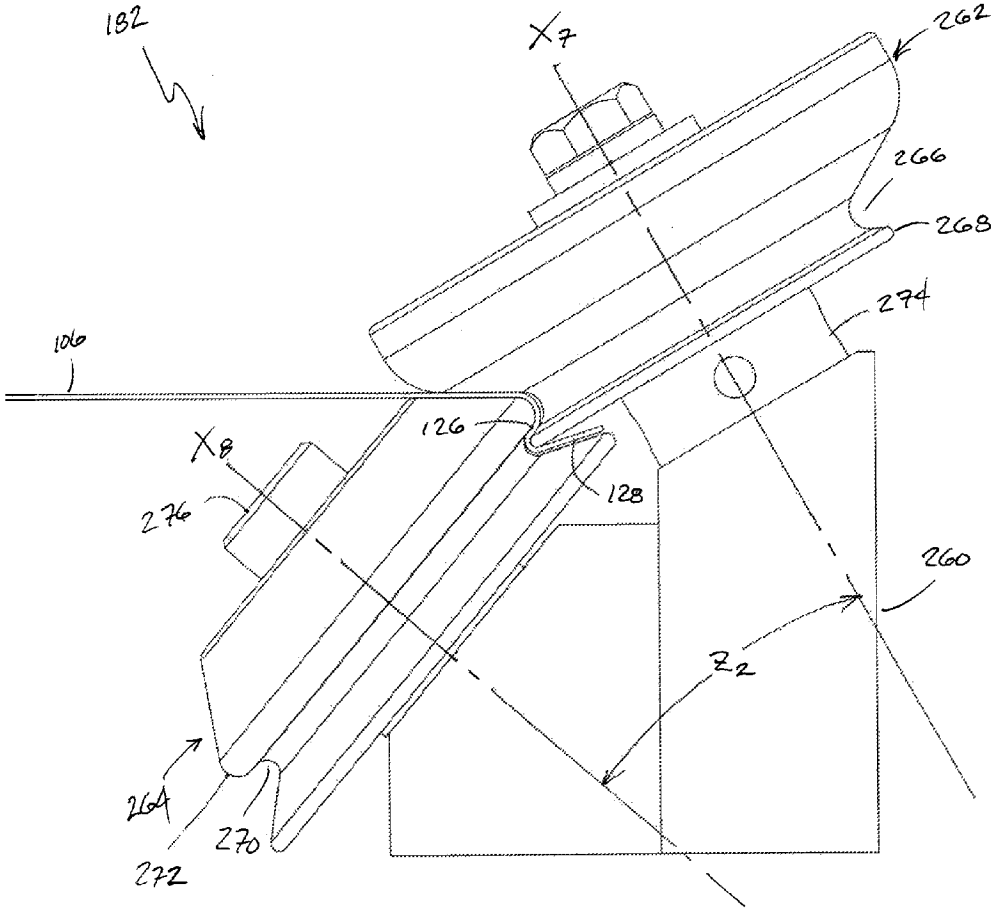
FIG. 12 is a front view of a fourth forming station for forming the female sidelap portion.

FIG. 12 illustrates fourth station 182 that is operative to further form ledge 126 and latching flange 128. Fourth station 182 includes a bracket 260 which supports shafts 274 and 276. The seventh roller 262 and eighth roller 264 are rotatably mounted on shafts 274 and 276, respectively. Accordingly, seventh roller 262 and eighth roller 264 are mounted for rotation about axes $X_7$ and $X_8$. Axes $X_7$ and $X_8$ are oriented at an acute angle $Z_2$ with respect to each other. Seventh roller 262 includes a fifth bead 268 and eighth roller 264 includes a fifth groove 270 mateable with fifth bead 268. Seventh roller 262 also includes a sixth groove 266 adjacent the fifth bead 268, and the eighth roller 264 includes a sixth bead 272 adjacent the fifth groove 270 and mateable with the sixth groove 266.

Figure 13:
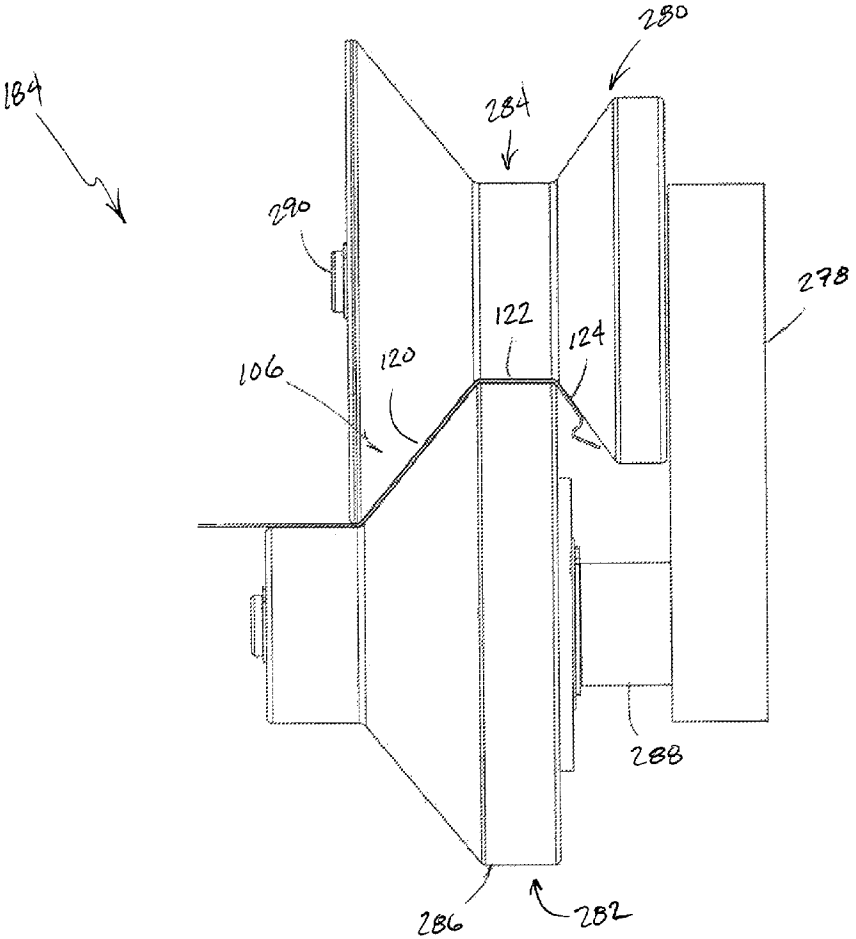
FIG. 13 is a front view of a representative female sidelap forming station.

FIG. 13 illustrates a station 184 that is operative to begin the progressive process of bending the standing flange 120 and cross-flange 122 of the female sidelap portion 106. Station 184 includes a bracket 278 with shafts 288 and 290 supporting rollers 280 and 282, respectively. Roller 280 includes a groove 284 that mates with the forming surface 286 of roller 282.

Figure 14:
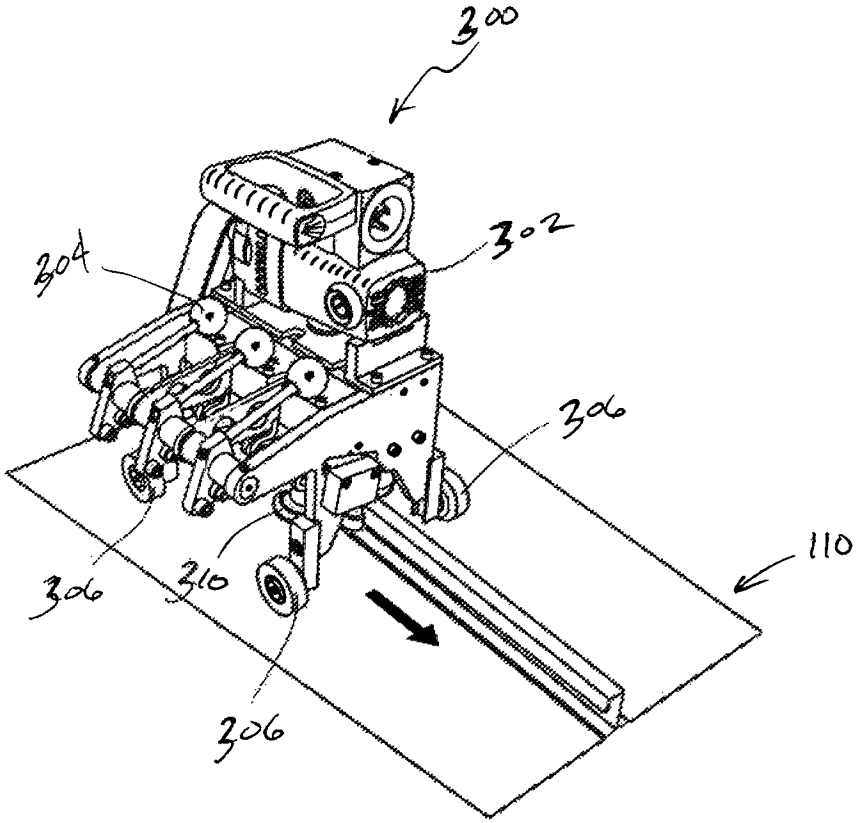
FIG. 14 is a perspective view of a seaming mechanism according to a representative embodiment operative to mechanically seam adjacent standing seam panels.
Figure 15:
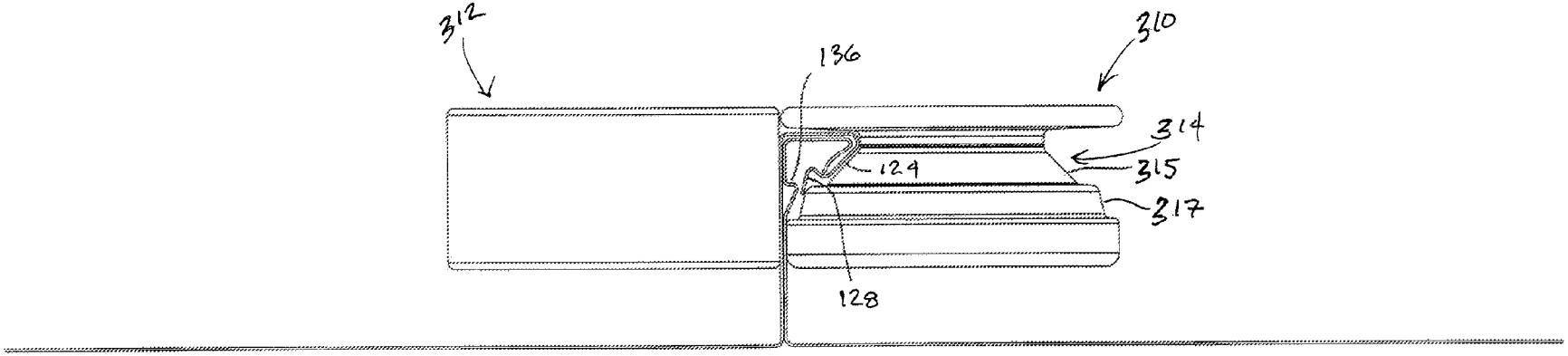
FIG. 15 is a front view of a pair of outer seaming rollers.
Figure 16:
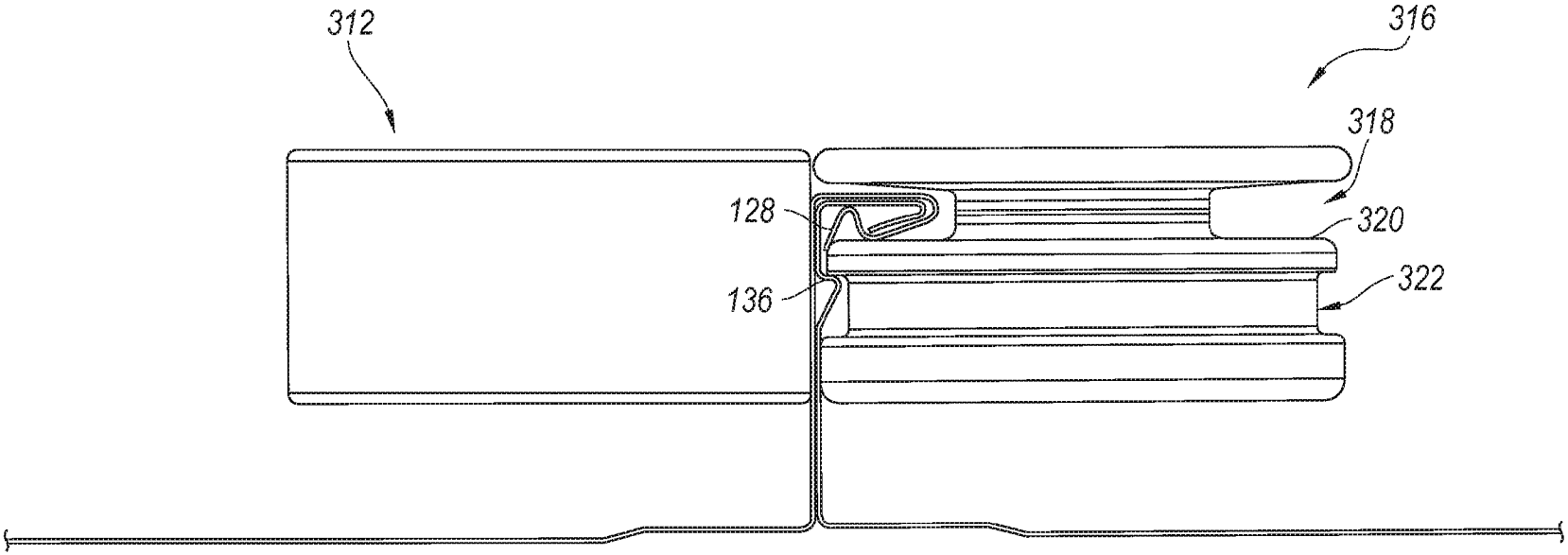
FIG. 16 is a front view of a pair of inner seaming rollers.

FIG. 14 illustrates a seaming mechanism 300 that is attachable to the male sidelap portion and female sidelap portion of standing seam panel assembly 110. Seaming mechanism 300 includes a drive motor 302 operative to propel the mechanism 300 along the seam. Seaming mechanism 300 travels on rollers 306 that roll along the central panel portions of the standing seam panels. A plurality of rollers, including roller 310, are operative to seam the panels together. In this embodiment, the seaming mechanism 300 includes three sets of rollers corresponding to three clamps 304. Clamps 304 allow the seaming mechanism to be engaged with, and disengaged from, the panel seam. In this embodiment, the seaming mechanism 300 includes two outer roller sets and one inner roller set. The two outer roller sets are the same, thereby allowing the seaming mechanism 300 to be operated in either direction. With reference to FIG. 15, each outer roller set includes a flat roller 312 that confronts the first standing flange of the female sidelap portion and an outer seaming roller 310 that urges the latching flange 128 toward ledge 136. Roller 310 includes a groove 314 that includes angled surfaces 315 and 317 that are operative to push against return flange 124 and latching flange 128. FIG. 16 illustrates the inner roller set which comprises a flat roller 312 and an inner seaming roller 316. Roller 316 includes a groove 318 with a latching surface 320 that pushes latching flange 128 beyond ledge 136. Once the seaming rollers have moved past a portion of the seamed panels, the latching flange 128 and return flange 124 relax into position such that latching flange 128 is latched against ledge 136. Roller 316 also includes a ledge relief 322 to provide clearance for ledge 136 while latching surface 320 pushes latching flange 128 into position.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment," "an embodiment," or the like means that a particular feature, structure, or characteristic described in connection with the embodiment is included in at least one embodiment of the disclosure. The appearances of the phrase "in one embodiment" or "in some embodiments" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A standing seam panel assembly, comprising:

a first standing seam panel including a male sidelap portion; and a second standing seam panel including a female sidelap portion sized to receive the male sidelap portion for interlocking engagement therein;

wherein the female sidelap portion includes a latch flange engaged with the male sidelap portion and the male sidelap portion includes a second latch flange engaged with the female sidelap portion;

wherein the male sidelap portion further comprises:

a standing flange;

a cross-flange extending transversely from the standing flange, wherein the second latch flange extends transversely from the cross-flange; and a ledge disposed on the standing flange; and wherein a first end of the latch flange of the female sidelap portion is engaged with the ledge of the male sidelap portion when the male sidelap portion and female sidelap portion are seamed.

2. The standing seam panel assembly of claim 1, wherein the female sidelap portion includes:

a second standing flange;

a second cross-flange extending transversely from the second standing flange;

a second return flange extending transversely from the second cross-flange;

a second ledge extending transversely from the second return flange; and wherein the second latch flange extends from the second ledge.

3. The standing seam panel assembly of claim 1, wherein the second standing seam panel includes a second female sidelap portion; and the second standing seam panel includes a second male sidelap portion.

* * * * *